United States Patent [19]

Jeschke et al.

[11] 3,986,455

[45] Oct. 19, 1976

[54] SHEET GUIDING DRUM FOR PRINTING PRESSES

[75] Inventors: Willi Jeschke, Heidelberg; Arno Wirz, Bammental, both of Germany

[73] Assignee: Heidelberger Druckmaschinen Aktiengesellschaft, Heidelberg, Germany

[22] Filed: Oct. 31, 1974

[21] Appl. No.: 519,622

[30] Foreign Application Priority Data

Oct. 31, 1973 Germany ..... 2354418

[52] U.S. Cl. ..... 101/409; 101/415.1; 271/276

[51] Int. Cl.[2] ..... B41F 1/32; B41F 21/04

[58] Field of Search ..... 101/382 MV, 409, 425, 101/407 R, 408; 271/276, 195, 82; 239/513, 515; 138/37, 40

[56] References Cited

UNITED STATES PATENTS

| | | | |
|---|---|---|---|
| 2,138,178 | 11/1938 | Lang | 271/195 X |
| 2,184,954 | 12/1939 | Conn | 239/513 X |
| 2,571,768 | 10/1951 | Schlonau et al. | 239/513 |
| 2,612,105 | 9/1952 | Skinner | 101/132.5 |
| 2,757,610 | 8/1956 | Gegenheimer et al. | 101/183 |
| 3,096,088 | 7/1963 | Young | 101/409 X |
| 3,120,805 | 2/1964 | Simon | 101/425 |
| 3,136,539 | 6/1964 | Lyman | 271/195 X |
| 3,236,517 | 2/1966 | Lyman | 271/195 X |
| 3,243,181 | 3/1966 | Lyman | 271/195 X |
| 3,334,897 | 8/1967 | Sharkey | 101/409 X |
| 3,622,151 | 11/1971 | Range | 271/195 X |
| 3,658,003 | 4/1972 | Johnson | 101/425 |
| 3,683,730 | 8/1972 | Driessen | 271/195 X |
| 3,796,154 | 3/1974 | Weisgerber | 101/409 X |
| 3,844,189 | 10/1974 | Jardine | 271/195 X |

FOREIGN PATENTS OR APPLICATIONS

| | | | |
|---|---|---|---|
| 1,070,007 | 11/1959 | Germany | 271/276 |

*Primary Examiner*—E. H. Eickholt
*Assistant Examiner*—Paul J. Hirsch
*Attorney, Agent, or Firm*—Herbet L. Lerner

[57] ABSTRACT

Sheet guiding cylinder for printing machines formed with a cylinder channel and having a clamping device disposed in the channel for gripping a sheet that is to be imprinted, the cylinder having a rotary axis and being rotatable in a given rotary direction, and includes a cylinder casing whereon a sheet to be imprinted is supportable, a plurality of rows of nozzles connectible to pressurized air-producing means, the rows of nozzles being disposed in the cylinder casing and extending parallel to the cylinder axis, and a plurality of peripheral flow channels formed at the outer surface of the cylinder casing and being at least partly coverable by the sheet to be imprinted, the nozzles of the rows of nozzles communicating respectively with the flow channels, the flow channels being disposed substantially parallel to the cylinder axis and having a cross section increasing with increasing distance from the nozzles in a peripheral direction opposite to the given rotary direction of the cylinder.

5 Claims, 8 Drawing Figures

Fig. 1
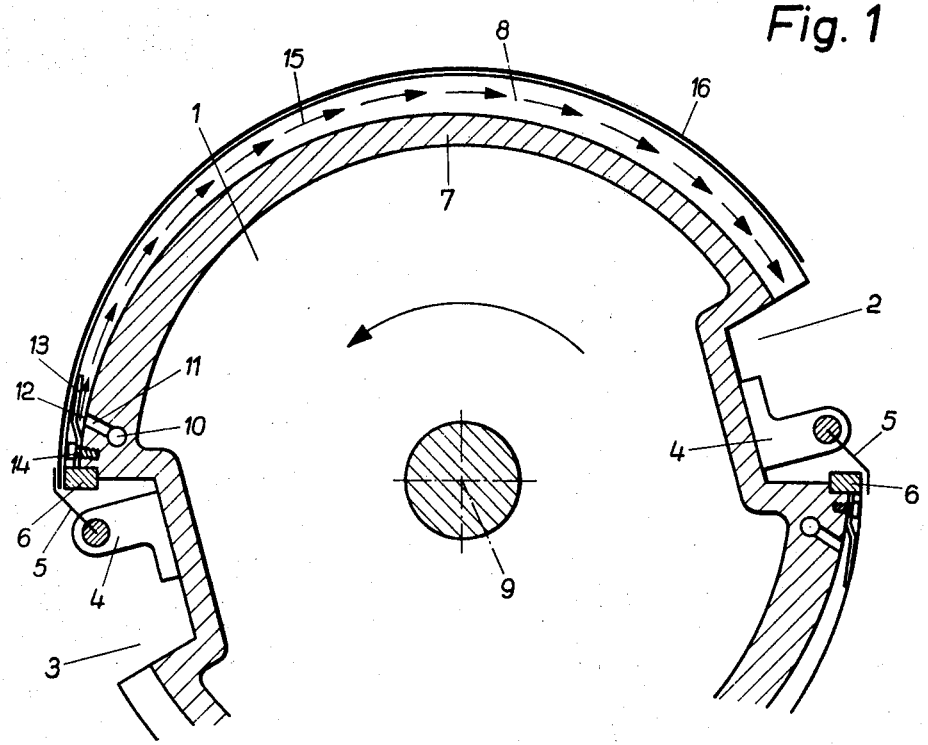
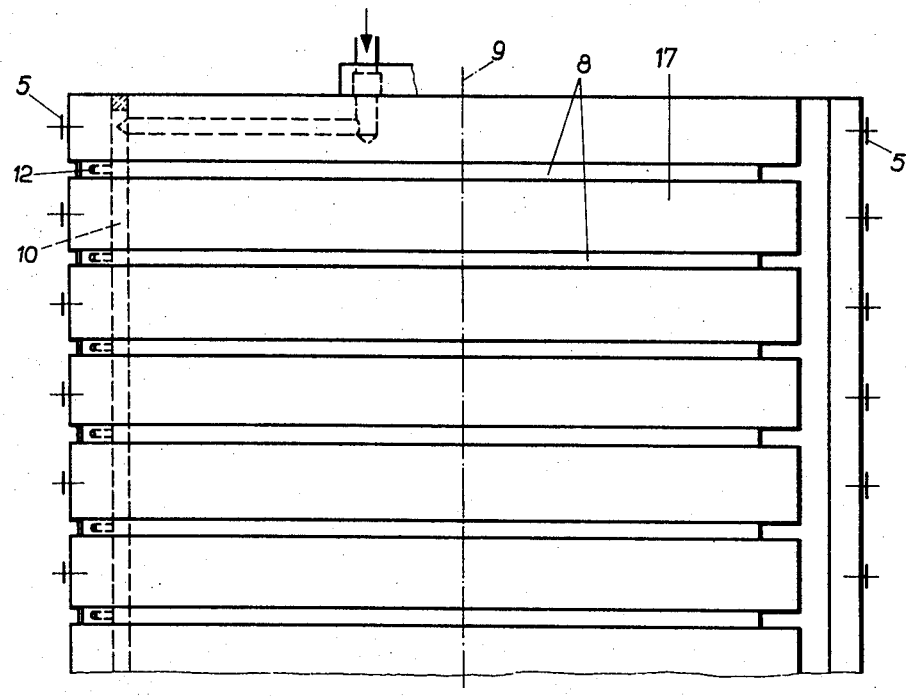
Fig. 2

SHEET GUIDING DRUM FOR PRINTING PRESSES

The invention relates to a sheet guiding drum or cylinder for printing presses and, more particularly, of the type formed with a cylinder channel wherein a device for gripping the forward or leading edge of a sheet is disposed.

From German Petty Patent GBM 6 949 816, a sheet guiding drum or cylinder is known in which, besides gripping the forward or leading edge of the sheet, suction air is used to suck the gripped sheet against the cylinder surface, for better guidance. Furthermore grippers or suckers are provided for holding the rear or trailing edge of the sheet being transfered. Such devices are employed in perfector presses or printing machines capable of printing either on a single side or on both sides of a sheet. German patents 1 155 145 and 1 611 241 describe various embodiments of sheet guiding drums or cylinders of this type. They are distinguished particularly in that the sheet which is held by grippers at the forward or leading edge thereof, is sucked in at the rear or trailing edge thereof and is retained under slight tension acting in a direction opposite to the direction of rotation. The tension is produced by adjusting holding devices that engage the rear or trailing edge of the sheet. A crease-free and wrinkle-free sheet transfer to the sheet reversing or turn-over cylinder of the perfector press is sought to be achieved by the foregoing heretofore known constructions.

It is furthermore known from Swiss patent 346 226, to suck the seized or gripped sheet by means of suction holes or bores against the surface of the transfer cylinder. However, since the sheets may become deformed during the printing operation or during the transfer, they are also firmly sucked in this condition through the suction holes so that, at the transfer to the next gripper, due to a release in the tension in the sheet, a position change relative to the grippers occurs which causes registry inaccuracies.

The heretofore known guide drums or cylinders noted hereinabove have in common the disadvantage that at a format change, the suction or clamping devices for the rear or front edge of the sheet, as well as their guide members, have to be readjusted in accordance with the format length. This adjustment signifies an increase in the shutdown time of the printing press. Furthermore, intentional stressing by mechanical means of the sheet gripped by the guide drum, during transfer, involves the danger that, under certain conditions, the required amount of stress relief will be exceeded so that, in effect, the sheet will again become subject to tension.

It is accordingly an object of the invention to provide a sheet guiding drum or cylinder whereon a sheet is held without tension by simple means during transfer, so that accurate registry of the guided sheet is ensured regardless of the format, with adjustment of gripping or suction devices either at the forward or rear edges of the sheet.

With the foregoing and other objects in view, there is provided, in accordance with the invention, a sheet guiding cylinder for printing machines formed with a cylinder channel and having a clamping device disposed in the channel for gripping a sheet that is to be imprinted, the cylinder having a rotary axis and being rotatable in a given rotary direction, and comprising a cylinder casing whereon a sheet to be imprinted is supportable, a plurality of rows of nozzles connectible to pressurized air-producing means, the rows of nozzles being disposed in the cylinder casing and extending parallel to the cylinder axis, and a plurality of peripheral flow channels formed at the outer surface of the cylinder casing and being at least partly coverable by the sheet to be imprinted, the nozzles of the rows of nozzles communicating respectively with the flow channels, the flow channels being disposed substantially parallel to the cylinder axis and having a cross section increasing with increasing distance from the nozzles in a peripheral direction opposite to the given rotary direction of the cylinder.

According to the invention, the sheet is thus retained on the sheet guiding drum or cylinder by the aerodynamic paradox effect. The application of the aerodynamic effect for guiding and braking sheets is known, per se, for example from German Published Non-Prosecuted Application DOS 2 137 115 in connection with sheet delivery systems. Due to the aforementioned effect, there is supposed to be an assurance of better contact of the sheet with the suction drum or roller of the sheet delivery device. However, this heretofore known device deals with a stationary guidance which does not permit any control of the registry.

In accordance with another feature of the invention, the cylinder casing is formed with a transverse bore adjacent the cylinder channel, the transverse bore extending parallel to the cylinder axis and being, on the one hand, connectible to the pressurized air-producing means and, on the other hand, connected at regularly spaced intervals by one of the nozzles of each of the rows of nozzles to a respective flow channel.

From the nozzles which are located directly behind the gripping edge, an air blast is introduced into the groove or slot-shaped flow channels so that the sheet is sucked against the cylinder casing by the air stream forming under it, and is simultaneously smoothed out or extended without stress in a direction opposite to the rotary direction of the cylinder. In this manner, immediately after printing, the sheet is relieved from the tensions which were caused by the printing process and sheet transfer, and the transfer to the next gripper can take place without any harmful distortion or stressing of the sheet. The conditions for perfect registry accuracy are thereby achieved.

A further advantage of the invention is offered by the ease of operation thereof. For example, an adjustment of the clamping devices for different format lengths is not required. Furthermore, the rear or trailing edge of the sheet is retained on the sheet guiding drum or cylinder without clamping devices, a fact that is important with sheet turnover devices for perfector operation of printing machines which print either on one or both sides of a sheet. As is generally known, in such machines, the sheet which has already been imprinted by the first printing unit is directed to a so-called sheet turnover drum by the sheet guiding drum or cylinder which has a diameter that is twice that of the turnover drum, it being essential that the printing on the outside not be smeared by the previously turned over and advanced sheet.

Also, a sheet guide drum or cylinder constructed according to the invention permits the use of maintenance-free low pressure blowers or pumps. Paper dust and powder are not sucked in thereby. This avoids clogging of the suction line and increased wear of the compressor.

In accordance with a further feature of the invention, each of the flow channels is formed, along the sheet supporting part of the cylinder casing, of an upwardly open groove, and guide baffle means are disposed in each of the flow channels above the nozzles.

In accordance with yet another especially useful embodiment of the invention, the sheet-supporting casing is in the form of a sheet metal covering, and the nozzles are in the form of openings provided in respective nozzle tubes spaced at regular intervals peripherally about the casing and extending parallel to the cylinder axis, the nozzle tubes being connectible to the pressurized air-producing means, guide baffle means extending in peripheral direction of the casing from each of the nozzle tubes and together with the sheet metal covering defining the respective flow channels, each of the nozzle tubes having nozzle openings communicating with the flow channels, respectively, the sheet metal covering being formed with suction slits respectively above the nozzle openings.

In accordance with an additional feature of the invention, the sheet guiding cylinder has a flange at at least one end thereof, and means at the outside of the flange for mounting the nozzle tubes so as to be turnable about their longitudinal axes. The possibility is thereby afforded of effecting optimal adjustment of the suction force to the existing conditions.

For example, a far greater suction force is required for heavy papers than for onion skin. It has also sometimes proven to be advantageous if the suction force at the rear or trailing edge of the guided sheet is separately adjustable.

Although the invention is illustrated and described herein as embodied in sheetguiding drum for printing presses, it is nevertheless not intended to be limited to the details shown, since various modifications and structural changes may be made therein without departing from the spirit of the invention and within the scope and range of equivalents of the claims.

The construction and method of the invention, however, together with additional objects and advantages thereof will be best understood from the following description of specific embodiments when read in connection with the accompanying drawings, in which:

FIG. 1 is a diagrammatic cross-sectional view of a sheet guiding drum or cylinder having twice the diameter of the other drums or cylinders of the printing mechanism, and having groove-shaped flow channels formed in the cylinder surface thereof;

FIG. 2 is a top plan view of the sheet guiding drum or cylinder of FIG. 1;

Figure 7:
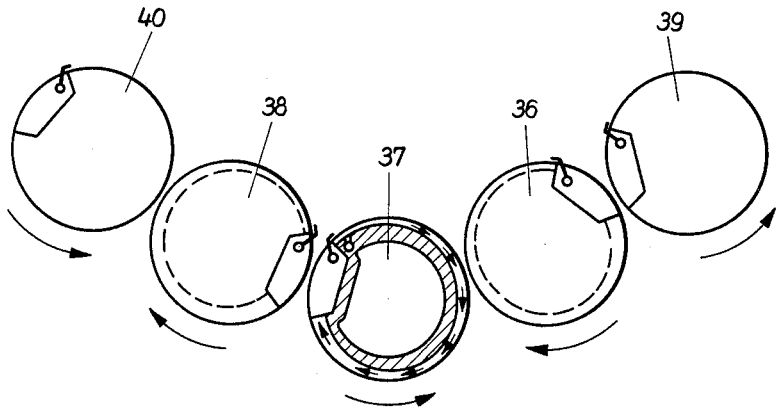
Figure 8:
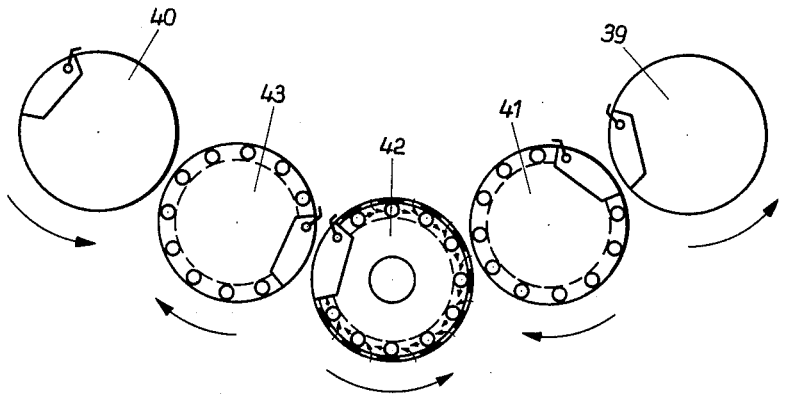

FIG. 7 is a diagrammatic view of the assembly of three sheet guiding drum or cylinders of a size equal to that of the printing drums or cylinders with groove-shaped flow channels between two single side sheet printing mechanisms; and FIG. 8 is a diagrammatic view of the assembly of three sheet guiding drums or cylinders having flow channels disposed consecutively between two single side sheet printing mechanisms all of the drums or cylinders having equal diameters.

Figure 5:
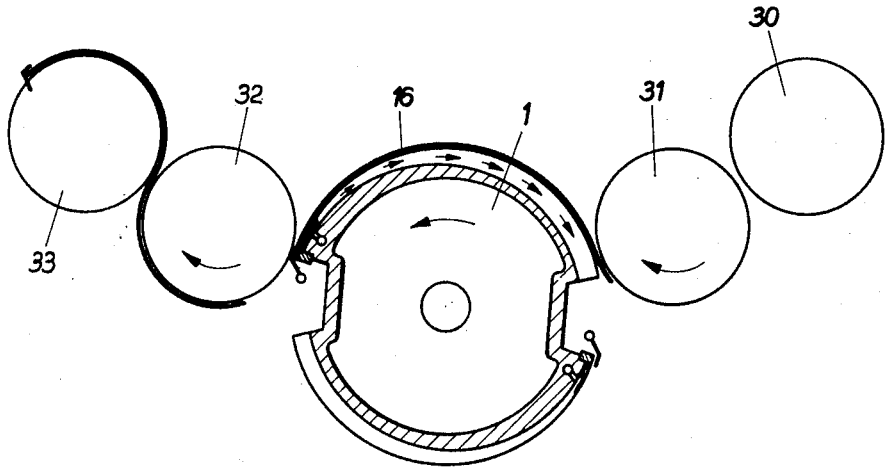
FIG. 5 is a diagrammatic view of the assembly of a sheet guiding drum or cylinder according to FIG. 1 between two printing mechanisms of a multicolor sheet-fed rotary printing press.

Referring now to the drawing and, particularly, to FIGS. 1 and 2 thereof, there is shown a plan view, partly in section, of a sheet guiding drum or cylinder 1 having twice the diameter of the other drums or cylinders of a printing unit assembly such as shown in FIG. 5, for example. Therefore, two cylinder channels 2 and 3 are provided wherein clamping devices 4 are mounted. Both clamping devices 4 are formed of a gripping member 5 and a gripper support rail 6.

Between the channels 2 and 3 formed in the cylinder casing 7, regularly spaced-apart, groove-shaped flow channels 8 are recessed. The flow channels 8 extend in planes perpendicular to the rotary axis 9 of the sheet guiding drum or cylinder, or inclined slightly to the ends of the drum or cylinder. The flow channels start at the gripper support rail 6 of the gripping devices of the one cylinder channel 3 and terminate in the other cylinder channel 2, on the one hand, and start at the support rail 6 of the gripping devices of channel 2 and end in the other channel 3, on the other hand. The depth of the groove increases uniformly toward the end of each flow channel. That means that the cross section of the respective flow channels 8 increases uniformly in a direction opposite to the rotary direction of the sheet guiding drum or cylinder 1.

Immediately behind the gripper support rail 6, a transverse bore 10 is provided in the cylinder casing 7 and extends parallel to the rotary axis 9 of the sheet guiding drum or cylinder. The transverse bore 10 is connected to a compressed air producer, such as a low pressure blower, for example, through the intermediary of air control devices. Neither the air control devices nor the blower are shown in the drawing.

The transverse bore 10 is connected to each flow channel 8 by a respective nozzle bore 11. Above the nozzle opening 12 of the bore 11, there extends a guide baffle 13 which is secured in the respective flow channel 8 by a screw 14. The air stream blown out of the nozzle bores 11 is directed into the respective flow channel 8 by the guide baffle 13. The air blast supplied through the transverse bore 10 thus flows in the flow channels 8 as shown by the arrows 15. A reduced or negative pressure is thereby formed in the flow channels 8 and, due to the fact that the channels 8 are open at the top thereof, have the effect of applying a suction force on the sheet 16 which is gripped by the clamping devices 4.

Due to the increasing covering of the channel 8 by the sheet 16, the flow channel is continuously lengthened to the end of the sheet. The continuous channels present a large engagement area to the underside of the sheet, whereby a large holding force is produced. The particular configuration of the cross section of the flow channels 8 has the effect that the force of suction over the entire sheet-carrying periphery of the sheet guiding drum or cylinder is virtually uniform. The clamped sheet 16 is thus drawn against the support ribs 17 of the cylinder casing 7 and, furthermore, when applied, it is smoothed out and thereby relieved of stresses.

Figure 3:
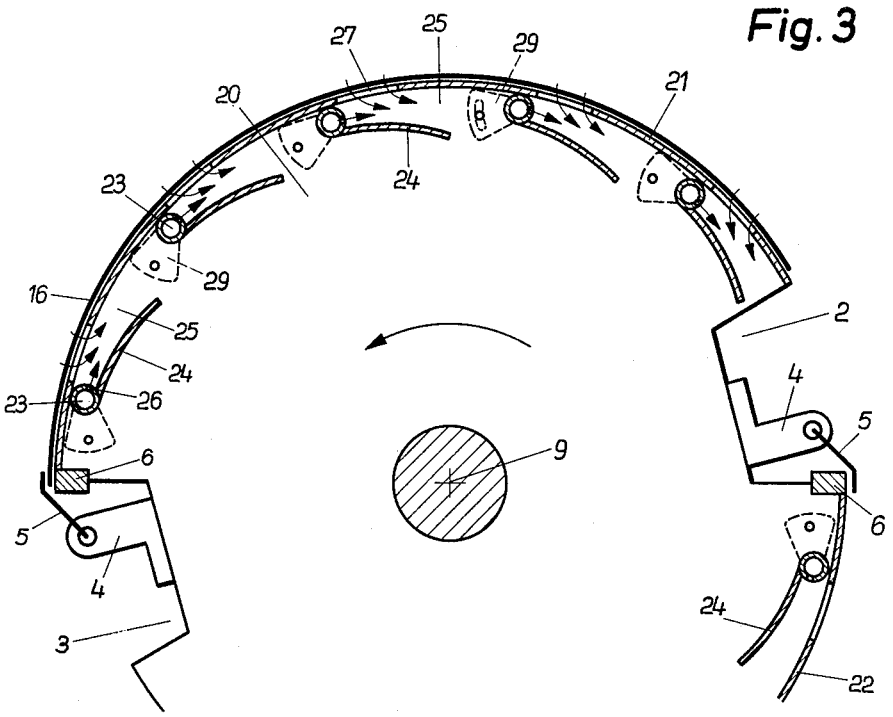
FIG. 3 is a view similar to that of FIG. 1 of a sheet guiding drum or cylinder, also of double the diameter, but formed, however, with several flow channels disposed consecutively at the periphery.
Figure 4:
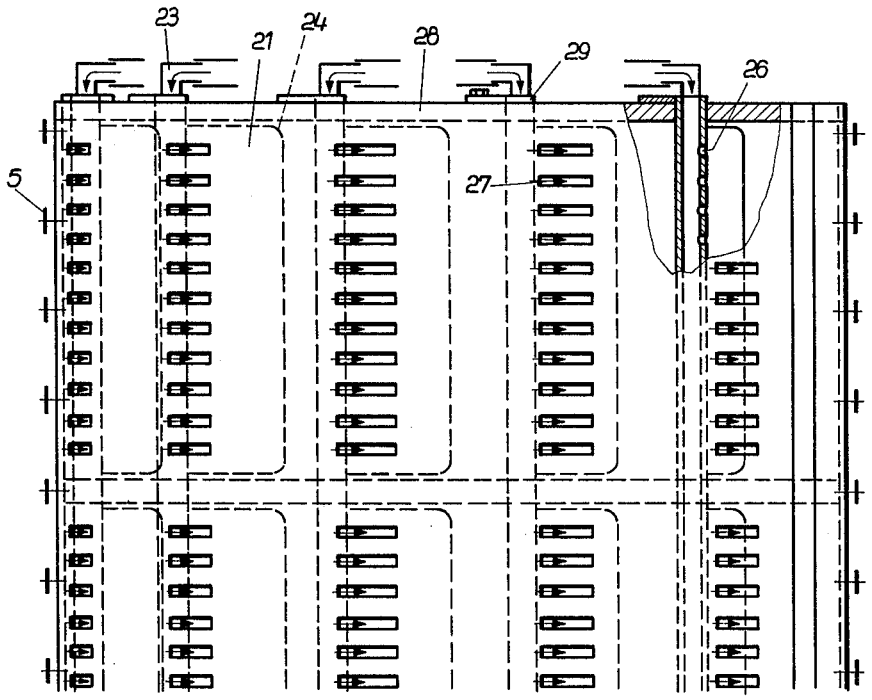
FIG. 4 is a top plan view of the sheet guiding drum or cylinder of FIG. 3.
Figure 6:
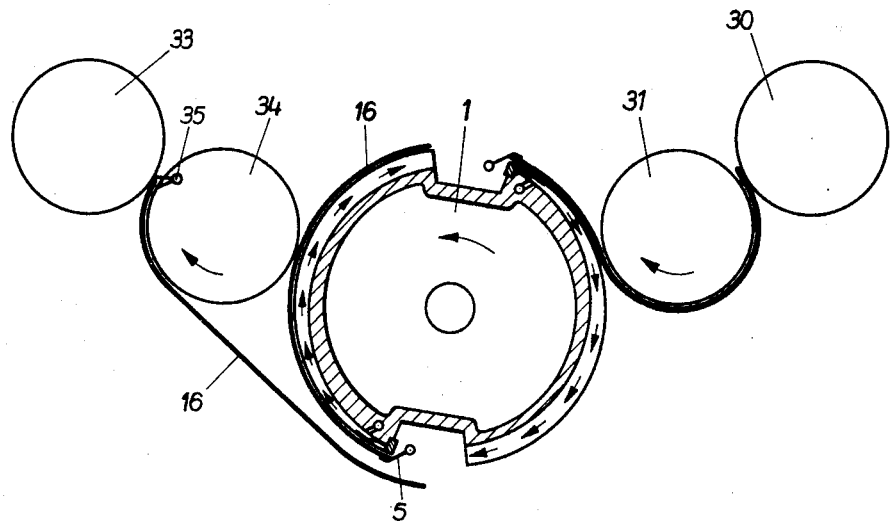
FIG. 6 is a diagrammatic view of the assembly of a sheet guiding drum according to FIG. 1 between transfer drums of a printing machine which prints on one or both sides of a sheet.

In FIG. 3, a sheet guiding drum or cylinder 20 is shown diagrammatically in section, while FIG. 4 shows the same drum or cylinder in plan view. This sheet guiding drum or cylinder 20 also has a diameter that is twice that of the other drum or cylinder of the assembled printing unit (such as shown in FIGS. 5 and 6). The drum or cylinder 20 also is formed with two cylinder channels 2 and 3 in which clamping devices 4 are mounted. These clamping devices 4 also are formed of gripping devices 5 and respective gripper support rails 6.

Located between the cylinder channels 2 and 3, are areas which support the sheet and which are covered by metal casing sheets 21 and 22. Beneath each of the metal cover sheets 21 and 22, respectively, five nozzle tubes 23 are disposed substantially symmetrically to the periphery and extending parallel to the rotary axis 9 of the sheet guiding drum or cylinder 20. All ten nozzle tubes 23 are connected to a low pressure blower, not shown in the drawing.

At the underside of each nozzle tube 23, there is provided a guide baffle 24 which extends nearly parallel to the respective metal cover sheets 21 and 22. The respective guide baffles 24 in conjunction with the respective metal cover sheets 21 and 22 form respective flow channels 25. The nozzle tubes 23 are formed with evenly spaced nozzle bores 26 which are directed so that air blown from the nozzle bores 26 flows in direction of the flow channels 25. In the metal cover sheets 21 and 22, a suction slit 27 is provided above each nozzle bore 23. The suction slits are elongated and extend in direction of the related flow channels 25.

The metal casing or cover sheets 21 and 22 are secured at the end flanges 28 of the sheet guiding drum or cylinder 20. The nozzle tubes 23 are also applied to the outer side of the end flange 28 of the drum or cylinder, in fact, through bearing plates 29. By adjustable disposition of the bearing plates 29, the nozzle tubes 23 can be rotated around the longitudinal axes thereof, the respective guide baffle 24, which is secured to the nozzle tubes 23, being pivotable thereby upwardly or downwardly, as viewed in FIG. 3.

The suction force acting upon the suction slit 27, is thus capable of being varied. Most of all, it makes it possible to provide a suction force of varied strength over the entire length of the sheet, by means of which, especially the end of the sheet can be held motionless. Since several sheet formats are able to be used, it is advantageous if several of the nozzle tubes are adjustable.

The sheet holding mechanism of the sheet guiding drum or cylinder 20 operates as follows:

The airstream discharging from the nozzles 26 of the nozzle tubes 23 flows into and along the length of the flow channel 25 which is defined respectively by the guide baffle 24 and the metal cover sheet 21. A low or negative pressure is accordingly produced which exerts a suction force above the suction slits 27 on the gripped sheet 16. The gripped sheet 16 is not only drawn towards the cylinder casing surface 21 thereby, but is also smoothed or stretched out and stress-relieved because of the direction of airflow which is opposite to the travel direction of the sheet.

As shown in FIG. 5, a sheet guiding drum or cylinder according to FIGS. 1 and 3 can be disposed between two transfer drums 31 and 32 of a two-color or multicolor sheet-fed rotary printing press. The transfer drum 31 takes over the sheet from a printing or impression cylinder 30, and the transfer drum 32 transfers the transported sheet to a printing or impression cylinder 33 of the next printing mechanism. Immediately after takeover of the printed sheet from the transfer cylinder 31 by the sheet guiding drum or cylinder 1, as a result of the action of the air blast, there begins on the one hand, an application of suction to the gripped sheet, and on the other hand a stretching or smoothing-out effect which produces stress relief of the sheet required for accurate registry in the succeeding printing operation.

As shown in FIG. 6, it is particularly advantageous for a sheet guiding drum or cylinder 1 to be disposed between the transfer cylinder 31, the sheet turn-over drum or cylinder 34 and the following printing or impression cylinder 33 of a perfector press or a printing press which prints on a single side or both sides of a sheet. The turn-over drum or cylinder 34 is equipped with pivotable pincer-like grippers 35 which are adjustable so that they can either grip the forward or leading edge of the sheet 16 which is guided by the sheet-guiding drum or cylinder 1 or grip its rear or trailing edge. In this connection, it is obviously an advantage that for a varying rear or trailing edge due to different format lengths, no adjustment of any clamping or suction devices is required, as is required with heretofore known constructions of this general type. The removal of the sheet from the sheet-guiding drum or cylinder 1 or 20 is quite simple. It is necessary only to raise the forward or rear edge of the sheet and to remove the suction effect. During the transfer phase, in which the grippers 5 are already raised from the forward edge of the sheet, and the pincer gripper 35 is about to seize the rear edge of the sheet, the suction force in the flow channels 8 ensures that the sheet 16 lying on the sheet-guiding drum or cylinder 1 continues to be guided accurately, so that no inaccuracies of registry can occur during the period of transfer.

Sheet-guiding drums according to the invention can also be used as single revolution cylinders in conventional multicolor single-sheet printing presses. FIG. 7, for example, shows such an assembly of three sheet-guiding drums 36, 37 and 38 with groove-shaped flow channels, as illustrated in FIG. 1. These three sheet-guiding drums 36, 37 and 38 are disposed between the impression cylinders 39 and 40 of two consecutive printing units. The particular advantage of the use of the inventive sheet-guiding drums in single-sheet printing presses is that they transfer the sheet from one printing unit to another without smearing the ink thereon.

In FIG. 8, there is shown a respective assembly of three sheet-guiding drums 41, 42 and 43 having consecutively disposed flow channels in accordance with the sheet-guiding drum or cylinder 20 illustrated in FIG. 3. In FIG. 8, the sheet is also transferred without smearing from impression cylinder 39 over three single-revolution sheet-guiding drums or cylinders 41, 42 and 43 to the next impression cylinder 40.

As mentioned hereinbefore, the invention of this application is not limited only to the described embodiments. For example, in order to control the suction force in the sheet-guiding drum or cylinder 20, the size of the suction slits can be increased or decreased by means of adjustable sliding shields. With the aid of these sliding shields, the suction slits can also be completely closed, if narrower or shorter sheets are to be transported. The pivotable guide baffles 24 of the sheet-guiding drum or cylinder 20 can also be subdivided in such a manner that a partial adjustment and thereby a varied setting of the suction force across the width of the drum or cylinder is rendered possible. Furthermore, a greater or lesser number of nozzle or blast tubes 23 can be installed.

We claim:

1. Sheet guiding cylinder for printing machines formed with a cylinder channel and having a clamping device disposed in the channel for gripping a sheet that is to be imprinted, the cylinder having a rotary axis and being rotatable in a given rotary direction, and comprising a cylinder casing whereon a sheet to be imprinted is supportable, a plurality of rows of nozzles, means for connecting said nozzles to positive pressurized air-producing means, said rows of nozzles being disposed in said cylinder casing and extending substantially parallel to the cylinder axis, and a plurality of peripheral positive air flow channels formed along the outer circumferential surface of said cylinder casing separate from said clamping device and comprising respective grooves having radially outwardly extending openings along at least part of the length thereof, said openings being at least partly coverable by the sheet to be imprinted, the nozzles of said rows of nozzles communicating respectively with said flow channels, said flow channels being disposed in respective planes substantially perpendicularly to the cylinder axis and having a cross section increasing with increasing distance from said nozzles in a peripheral direction opposite to the given rotary direction of the cylinder, said flow channels having means for guiding positive pressurized air therealong from said nozzles so as to induce negative pressure in said radially outwardly extending openings thereof to thereby attract and hold the sheet to be imprinted about the cylinder.

2. Sheet guiding cylinder according to claim 1 wherein said cylinder casing is formed with a transverse bore adjacent the cylinder channel, said transverse bore extending parallel to the cylinder axis and being, on the one hand, connectible to said pressurized air-producing means and, on the other hand, connected at regularly spaced intervals by one of the nozzles of each of said rows of nozzles to a respective flow channel.

3. Sheet guiding cylinder according to claim 2 including guide baffle means disposed in each of said flow channels above said nozzles.

4. Sheet guiding cylinder according to claim 1 wherein said sheet-supporting casing is in the form of a sheet metal covering and wherein said nozzles are in the form of openings provided in respective nozzle tubes spaced at regular intervals peripherally about said casing and extending parallel to the cylinder axis, said nozzle tubes being connectible to said pressurized air-producing means, guide baffle means extending in peripheral direction of said casing from each of said nozzle tubes and together with said sheet metal covering defining said respective flow channels, each of said nozzle tubes having nozzle openings communicating with said flow channels, respectively, said sheet metal covering being formed with suction slits respectively above said nozzle openings.

5. Sheet guiding cylinder according to claim 4 including a cylinder flange at at least one end of the cylinder, and means at the outside of said cylinder flange for mounting said nozzle tubes so as to be turnable about their longitudinal axes.

* * * * *